United States Patent [19]

Mokry

[11] Patent Number: 4,802,068

[45] Date of Patent: Jan. 31, 1989

[54] SEALED CHAMBERS

[75] Inventor: Pierre Mokry, Les Clayes Sous Bois, France

[73] Assignee: Dow Corning France S.A., Valbonne, France

[21] Appl. No.: 118,930

[22] Filed: Nov. 10, 1987

[30] Foreign Application Priority Data

Nov. 20, 1986 [FR] France ..... 86-16152

[51] Int. Cl.[4] ..... F21V 31/00

[52] U.S. Cl. ..... G29362/61; 362/96; 362/294; 362/267; 116/59

[58] Field of Search ..... 362/61, 96, 267, 294, 362/80; 215/348; 277/23, 24; 55/522, DIG. 13; 116/59

[56] References Cited

U.S. PATENT DOCUMENTS

| | | | |
|---|---|---|---|
| 4,157,426 | 6/1979 | Hatanaka et al. | 528/31 X |
| 4,264,743 | 4/1981 | Mazuyama et al. | 521/172 X |
| 4,299,921 | 11/1981 | Youssef | 215/348 X |
| 4,569,007 | 2/1986 | Dick | 362/61 X |

FOREIGN PATENT DOCUMENTS

| | | | |
|---|---|---|---|
| 2306798 | 8/1974 | Fed. Rep. of Germany | 362/267 |
| 2555030 | 6/1977 | Fed. Rep. of Germany | 362/294 |
| 3542457 | 6/1987 | Fed. Rep. of Germany | 362/267 |
| 1293077 | 4/1962 | France | 362/294 |
| 2069792 | 9/1971 | France . | |
| 2225689 | 11/1974 | France . | |
| 2411692 | 7/1979 | France . | |
| 552888 | 12/1956 | Italy | 362/61 |
| 1064462 | 4/1967 | United Kingdom . | |
| 1326554 | 8/1973 | United Kingdom . | |
| 2010418 | 6/1979 | United Kingdom . | |

*Primary Examiner*—Ira S. Lazarus
*Assistant Examiner*—Richard R. Cole
*Attorney, Agent, or Firm*—Roger H. Borrousch

[57] ABSTRACT

The invention relates to chambers which are sealed against ingress of water and are provided with an element through which air may permeate to equalize pressures of air inside and outside the chamber. The element is of a foamed silicone and has a cellular fine pored layer of predominantly open cells having a skin to be contacted by air outside the chamber. Examples of chambers described and claimed are a vehicle horn and a vehicle headlight.

11 Claims, 1 Drawing Sheet

SEALED CHAMBERS

This invention is concerned with sealed chambers and is particularly concerned with articles which comprise a chamber in which a quantity of air is enclosed at an air pressure in equilibrium with the outside, which chamber is made impervious to the ingress of water in liquid form.

More particularly the invention is concerned with chambers which are intended for use on road vehicles, especially on cars and vans. Road vehicles are provided with articles having chambers which contain, e.g. electrically operated devices, which desirably are protected against ingress of water in liquid form in order to protect the contents from corrosive effects arising from entry of liquid water into the chamber. Examples of such articles include horns and headlamps. When used on road vehicles, the articles are subject to changes in the relationship between the pressure of air within the chamber and the pressure of air outside the chamber for example as a result of climatic changes, altitude changes or heating effects for example generated by use of electrically operated devices.

During use of road vehicles the fluctuations of the relationship between pressure of air outside the chamber and air within the chamber are such that it is desirable to provide the chamber with a capability to accommodate an air pressure difference of the order of 300 mbar in 15 minutes for 75 cc of air.

It has been proposed to form chambers of horns and headlamps from light weight plastics elements secured together in such a way as to prevent ingress of water, and in such a way as to prevent passage of air to and from the chamber between the elements. These chambers which are sealed against ingress of water are susceptible to dimensional instability when subjected to pressure variations which occur during use unless some means is provided to permit variation of the air pressure within the chamber to match existing atmospheric pressure. Provision of openings in the chamber to permit adequate pressure variation may lead to unwanted entry of water in liquid form into the chamber. There is a continuing need to provide improved means for permitting equalisation of air pressure inside and outside the chamber.

Horns for motor vehicles and particularly those for cars and vans, generally employ a chamber comprising a horn body housing in which an electromagnet is mounted and which is closed by a diaphragm secured to the housing and arranged for vibration upon actuation of the electromagnet, whereby to produce an audible warning sound. A tone disc may be mounted on the housing to modify the sound. A trumpet or the like element may be mounted on the housing for further modifying or directing the sound emitted by the vibrating diaphragm. It is a practice to seal such housings in order to protect the electromagnet from moisture. However, in order to ensure acceptable sound production of the horn irrespective of air pressure variations which may occur, it is desirable to ensure that the air pressure within the housing is permitted to vary so that air pressure on either side of the diaphragm may be permitted to become at least substantially equal within a short time. It is one practice to mount the diaphragm on a lip of the housing with a paper type gasket between them, and to clamp the diaphragm, gasket and housing by use of a clamp ring. By this method, satisfactory horns may be produced, but the paper type gasket may lead to an unsatisfactory seal against ingress of water due for example to incorrect assembly or excessive wetting during use. Attempts to improve the quality of seal by use of a more effective sealing medium have emphasised the problem of equalisation of pressure at opposite sides of the diaphragm during use of the vehicle.

In G.B. patent specification No. 1 326 554 there is described and claimed an audible warning device comprising a pot-shaped housing, a diaphragm closing the open front of the housing, a vibration generator cooperating with the diaphragm and situated in the space of the housing closed by the diaphragm and a passage, which opens into said space in the housing, passes through an external projection on the housing and is dimensioned sufficient for the passage of air, but at the same time is protected against the penetration of moisture. A passage is disclosed which contains a filter of a material having pores passing through it which have a size of the order of 5 microns. The filter may be a porous moulding of polyolefin, fluorohydrocarbon, or polyurethane or an (optionally silicone-treated) sintered ceramic or metal body. The need to provide a passage of the specified dimensions which is protected from being wetted and which may include a porous filter, secured for example by a separate cap, imposes constraints on the manufacture of the devices. In addition, the porous mouldings of polyolefins, fluorohydrocarbons, polyurethanes or similar substances disclosed as suitable filters are said to require protection against wetting. Whilst sintered ceramic filters surface treated with a silicone are disclosed these materials are rather expensive and may be somewhat too brittle for prolonged service.

Headlamps for motor vehicles generally comprise a chamber sealed against ingress of water comprising a housing which is formed to receive a bulb, and a lens or glass secured to a flange of the housing. A reflector is provided which may be a separate element mounted in the housing or may be a reflective coating on an inner surface of the housing. It is a practice to seal the joint between the lens or glass and the housing in order to protect the contents of the chamber from moisture. However, in order to ensure dimensional stability of the article, including the shape and disposition of the reflector, irrespective of air pressure variations during use, it is desirable to ensure the air pressure within the housing can change to match the ambient pressure.

In French Patent Specification No. 2225689 there is described a sealed vehicle headlamp having an aperture or passage spanned by a porous hydrophobic foil, the pores of which permit passage of gas but prevent passage of water. Foils of sintered fluorine containing polymers are referred to. The porosity of the foil and its attachment to the lamp are important factors to accommodation of air pressure differences within and outside the lamp coupled with exclusion of water from the lamp. The foils are attached by means providing a durable seal but these are comparatively expensive materials and have to be preformed.

It is an object of the present invention to provide an improved chamber in which a quantity of air is enclosed which is sealed against ingress of water in liquid form and which is capable of permitting variation of its internal air pressure to equilibriate the internal air pressure with the external air pressure. More particularly, it is an object of this invention to provide a simple method for providing in an aperture in the chamber a membrane which is permeable to air but not permeable to liquid water.

The applicant has now found that by means of an element of a selected foamed silicone rubber comprising a thin skin and a cellular layer located in a wall of a chamber, one may achieve equalisation of air pressures outside and inside the chamber sealed against ingress of water in liquid form to an extent sufficient to accommodate an air pressure difference of the order of 300 mbar in 15 minutes for a 75 cc volume of air, may be achieved.

The invention provides in one of its aspects an article having a chamber in which a quantity of air is enclosed which chamber is sealed against ingress of water in liquid form and is provided with an element through which air may permeate under the influence of differences between the pressures of air outside the chamber and air inside the chamber, characterised in that the element is of a foamed silicone comprising a cellular layer consisting of a fine pored foam of predominantly open cells having a skin disposed to be contacted by air outside the chamber and a surface disposed in contact with air inside the chamber.

The element is conveniently in the form of a plug or the like located in an opening provided in a wall of the chamber. The size of the opening and the composition of the element are selected to permit adequate variation of air pressure within the chamber. The opening should not be too large however, or the rate of transmission of moisture through the seal may be unacceptably high. Conveniently the opening may be provided by a hole about 5 mm in diameter.

If desired, more than one opening, obturated with an element as aforesaid, may be provided in the chamber.

The skin of the element is inherently somewhat permeable to air and impermeable to water in liquid form. Preferably the skin has a thickness between about 0.05 mm and about 0.25 mm, more preferably between about 0.1 mm and about 0.2 mm and is preferably free of perforations, although some minor amount of perforation may be acceptable, particularly in those cases where the cellular layer includes larger amounts of closed cells. The foamed material is selected with a view to contributing not only structural support for the skin, but also a measure of resistance to transmission of liquid water and is somewhat porous. The porosity is selected to complement the air permeability characteristic and resistance to penetration of liquid water of the skin, bearing mind the area of the opening which is to contain the element. Preferably the cellular layer is of substantially uniform consistency and has not less than about 60% open cells and not more than about 40% closed cells, preferably not less than 80% open cells, more preferably about 90% or more open cells and a density of about 50 to about 250 kg/m$^3$.

The element may be formed by casting techniques known in the art. As is known, the proportion of open to closed cells may be influenced by controlling the conditions under which the foam is moulded, for example by permitting free expansion of the foaming composition. The element is preferably formed by a process involving moulding a silicone room temperature vulcanising self skinning foam composition to desired shape under conditions in which the composition is free to expand under atmospheric conditions to provide a foam having an inner structure comprising evenly distributed cells and thin, integral, outer skins to provide said skin and said surface. The element may be moulded in situ or preformed to a desired shape for subsequent insertion in the wall of the chamber. If desired the element may be formed by casting into an annulus which later may serve for mounting the element in an opening formed in the wall of the chamber. Compositions suitable for use in the invention foam and cure by virtue of chemical reaction between alkylhydrogen polysiloxanes and polysiloxanes having silanol groups in presence of a catalyst, for example a tin carboxylate or a platinum compound.

Tin salts suitable for use in the invention include tin salts of carboxylic acids and particularly the stannous salts of the more commonly available carboxylic acids. Examples of suitable materials are dibutyl tin dilaurate, stannous acetate, stannous napthenate, stannous benzoate, stannous sebacate, stannous succinate and stannous octoate. Platinum catalysts may take any of the known forms, ranging from platinum as deposited on carriers such as silica gel or powdered charcoal, to platinic chloride, salts of platinum and chloroplatinic acids either as the hexahydrate or the anhydrous form and platinum complexes e.g. those prepared from chloroplatinic acid hexahydrate and divinyl tetramethyldisiloxane.

If desired one may also include in the composition one or more hydroxylated compounds and a polysiloxane having alkenyl e.g. vinyl groups, which may be beneficial if a platinum catalyst is employed.

Suitable siloxanes having silicon-bonded hydrogen atoms include polymers having units according to the general formula $$R_pHSiO_{\left(\frac{3-p}{2}\right)}$$

in which each R represents a lower alkyl or phenyl group e.g. a methyl group, and p is 1 or 2. These alkylhydrogen polysiloxanes may also comprise units $$R_nSiO_{\frac{4-n}{2}}$$

in which R is as referred to above and n is 1, 2 or 3. We prefer that each R represents a methyl group. Preferably terminal groups of the alkylhydrogen polysiloxane have the formula $R_3SiO_{\frac{1}{2}}$ where each R represents a methyl group. Suitable alkylhydrogen polysiloxanes include those comprising MeHSiO units with or without the presence of $Me_2SiO$ units and having viscosities of the order of from about $10^{-6}$ to about $10^{-4}$ m$^2$/s more preferably from about $10^{-6}$ to about $5\times10^{-5}$ m$^2$/s.

Suitable polysiloxanes having silicon-bonded hydroxyl or alkenyl groups include polymers which include units according to the general formula $$R_m(Q)SiO_{\frac{3-m}{2}}$$

in which each Q represents an OH group or an alkenyl group having 2 to 4 carbon atoms inclusive, for example a $-CH{=}CH_2$ or a $-CH_2-CH{=}CH_2$ group, each R represents a lower alkyl or phenyl radical e.g. a methyl radical and m is 1 or 2. These polysiloxanes also comprise units $$R_nSiO_{\frac{4-n}{2}}$$

in which R and n are as referred to above. These materials are preferably liquids and are chosen so that their functionality is appropriate in relation to the degree of chain extension and crosslinking required during curing of the composition. The polysiloxanes having silicon-bonded hydroxyl groups are preferably silanol terminated polydiorganosiloxanes according to the general formula

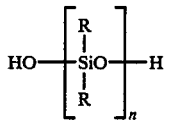

in which each R represents a methyl group and n has a value such that the polysiloxane has a viscosity of about $5\times10^{-4}$ to $2.5\times10^{-2}$ $m^2/s$ i.e. a number average molecular weight of the order of about 20,000 to about 80,000. Preferred materials have viscosities of the order of about $1.5\times10^{-3}$ to about $1.5\times10^{-2}$ $m^2/s$ and comprise, per molecule, primarily units according to the general formula $R_2SiO$ and two units according to the general formula $R_2(OH)SiO_{\frac{1}{2}}$. Preferred polysiloxanes having silicon-bonded alkenyl groups include those in which the alkenyl groups provide less than about 5% of the total silicon-bonded organic groups of the polymer. The alkenyl groups may be attached to terminal silicon atoms of the polysiloxane chain or to silicon atoms along the chain or both. Suitable alkenyl polysiloxanes include dimethylvinyl end blocked polysiloxanes for example those having viscosities up to about $8.5\times10^{-2}$ $m^2/s$ and phenylmethylvinyl end blocked polydimethylsiloxanes for example those having viscosities of about $2.5\times10^{-4}$ to about $10^{-2}$ $m^2/s$. In the preferred materials, each R represents a methyl radical.

Hydroxylated compounds used in a composition employed in the invention may be silicon compounds or organic compounds and may be mono-, di- or trihydroxy compounds for example. Suitable compounds include comparatively low molecular weight, i.e. short chained, organodifunctional polysiloxanes, for example u, m, dihydroxy polydimethylsiloxanes having up to twenty five dimethylsiloxane units in the molecular chain.

Compositions for use in the invention preferably include a monofunctional hydroxy compound effective as chain terminator. Such materials influence the structure of foams formed by use of the composition and their use is highly preferred where predominantly open-celled foams are desired. Suitable monofunctional hydroxy compounds include lower aliphatic alcohols, triorganosilanols and organosiloxanols which may be for example short chain siloxanes having for example up to about 25 siloxane units per molecule and having a terminal or pendant hydroxyl group, or a material of the general formula $R_3SiOH$ where each R may be for example a lower alkyl group e.g. a methyl group or a phenyl group.

Tri- and greater functional materials, e.g. hydroxylated compounds are included as crosslinking agents. Suitable crosslinking agents include materials having three or more functional e.g. hydroxyl groups per molecule. Preferred crosslinking agents include an alkoxysilane and/or a condensation product thereof capable of combining with three or more hydroxy polysiloxane molecules with release of the corresponding alcohol of the alkyl radicals, e.g. methyl trimethoxysilane, n-propylorthosilicate and ethyl polysilicate.

Fillers may be incorporated in compositions used in the invention. Any desired filler may be employed for example metal oxides, clays, fume silicas, hydrophobic silicas e.g. those prepared by treatment of finely divided silica with organochlorosilanes, organosiloxanes, organosilazanes or alkylsilanols and powdered glass.

Other ingredients may be included in the composition for example extenders, surfactants and pore size regulating agents, for example fluorine containing polysiloxanes.

Foamable polysiloxane compositions intended for use in providing the cellular element are conveniently provided in two parts for admixture immediately prior to casting the mixed composition to provide the element. The composition may comprise for example a part A, comprising 100 parts by weight $\alpha,\omega$, hydroxypolydiorganosiloxane having a molecular weight from about 20,000 to about 40,000, 5 to 20 parts by weight $\alpha,\omega$, hydroxypolydiorganosiloxane having a molecular weight from about 200 to about 2000, 15 to 30 parts by weight trimethylsiloxy end blocked methylhydrogen polysiloxanes, 3 to 5 parts by weight crosslinking agent, 5 to 15 parts by weight chain terminator and 20 to 30 parts by weight finely divided filler, and a part B comprising a tin carboxylate. Such a composition may be mixed in a ratio of the order of 100 parts by weight part A to 7 parts by weight part B and cast into the opening to provide a low density foam (approximately 120 to 200 $kg/m^3$) within about three minutes of mixing having an integrally formed skin about 0.1 mm to about 0.2 mm thick.

The invention provides in another of its aspects a method of providing an element in an article having a chamber in which a quantity of air is enclosed which chamber is sealed against ingress of water in liquid form through which element air may permeate under the influence of differences between the pressures of air outside the chamber and air inside the chamber, characterised in that the element is formed by moulding a foamable silicone composition to desired shape under conditions in which the composition is free to expand whereby to form a foamed silicone comprising a cellular layer consisting of a fine pored foam of predominantly open cells having a skin disposed to be contacted by air outside the chamber and a surface disposed in contact with air inside the chamber.

By use of the present invention one may provide an article having a chamber sealed against ingress of water in liquid form and yet capable of accommodating variations in pressure between air inside and air outside the chamber. The skin formed on the foam is an essential part of the element and serves as a membrane having different permeabilities to air and water, and the foam structure of the element provides a convenient mounting for the skin and a convenient achorage means which is also permeable to air passing through the membrane. Not all the commercially available silicone foam compositions are capable of providing suitable properties but by use of the foamed silicone compositions as aforesaid one may produce on a repetitive basis, using a comparatively simple inexpensive technique, chambers having elements effectively sealed against transmission of water and yet sufficiently permeable to air for pressures of air inside and outside the chambers to become equalised. The invention finds use in a variety of articles, and particularly in headlamps and horns for motor vehicles intended to be used under various climatic conditions and at various altitudes.

An article according to the invention may take the form for example of a vehicle headlamp in which the chamber is defined by a housing and a lens or glass secured to the housing. A reflector may be located in the housing and the element located in a wall of the housing.

As more fully described hereinafter, an article according to the invention may take the form for example of a vehicle horn in which the chamber is defined by a housing and a diaphragm secured to the housing. An electromagnet may be mounted in the housing and the element located in a wall of the housing.

In an article according to the present invention in the form of a vehicle horn, the diaphragm and horn body housing may be sealed together for example by use of an adhesive or sealant, for example a silicone composition. Similarly the lens or glass and housing of a vehicle headlamp according to the invention may be sealed together by use of an adhesive or sealant, for example a silicone composition. Suitable silicone compositions include the so-called room temperature vulcanised compositions e.g. the one part moisture-curable compositions based on reactive polysiloxanes, crosslinking silicon compounds and fillers. A variety of such materials is commercially available and are described in for example British Patent Specifications Nos. 862 576, 957 255 and 2 152 523.

In the case of a vehicle horn, if desired a tone disc may be located adjacent the diaphragm and secured to the periphery of the horn body housing. Conveniently, the tone disc is secured by means of an adhesive or sealant as used to secure the diaphragm and housing. Further, a trumpet element, for example of a moulded plastic construction and having a suitable outlet for sound generated by the diaphragm, may be secured to the housing.

The invention will be more clearly explained by the following description to be read with the accompanying drawing of an example article according to the invention, in the form of a vehicle horn.

Figure 1:
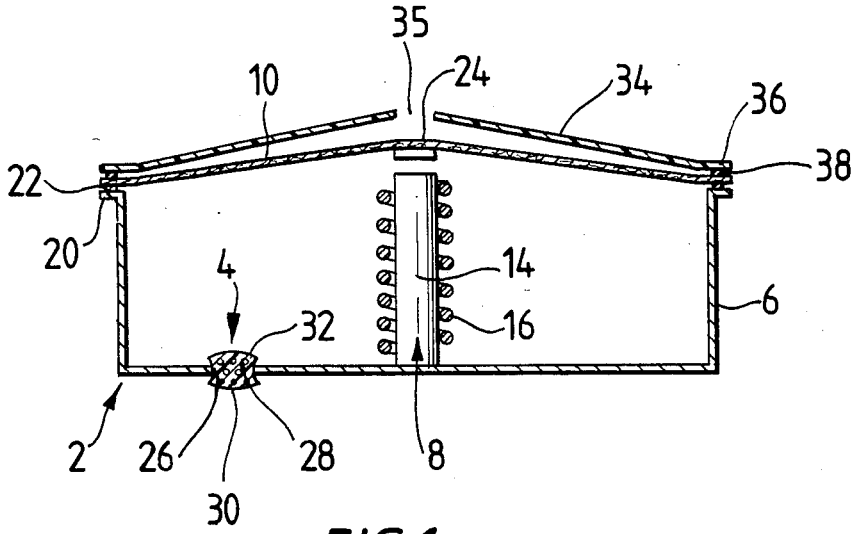
FIG. 1 is a diagram partly in section of the example horn as viewed from one side.
Figure 2:
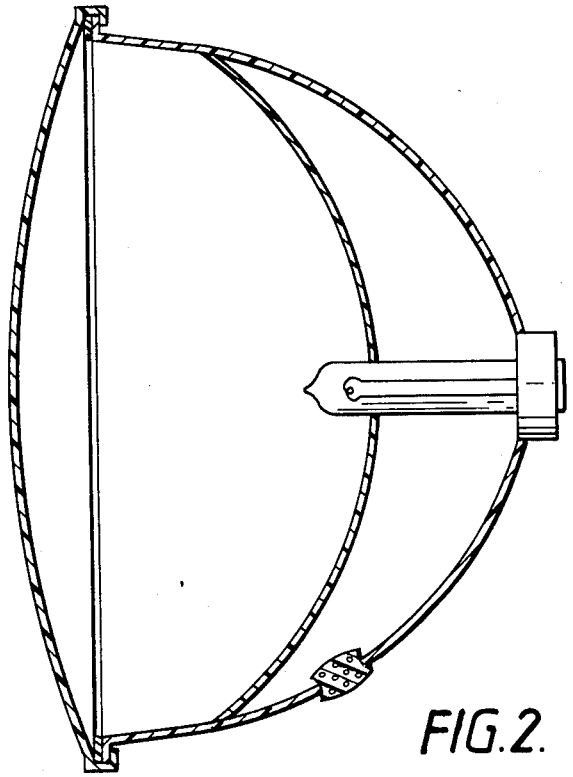
FIG. 2 is a diagram partly in section of the example as a vehicle headlamp.

The example horn comprises a chamber (2) in which a quantity of air is enclosed. This chamber is sealed against ingress of water in liquid form and is provided with an element (4) through which air may permeate under the influence of differences between the pressures of air outside the chamber and air inside the chamber.

The chamber (2) is defined by a housing (6), in which an electromagnet (8) is mounted, and a diaphragm (10) secured to the housing. The housing (5) is generally cylindrical and dish shaped. The electromagnet (8) comprises a core (14) secured to the housing and a coil (16) thereon. The diaphragm (10) is secured to an annular flange (20) at the periphery of the housing (6) to close the mouth of the housing, by means of a bead (22) of a one part RTV sealant comprising a polysiloxane, a crosslinker and a calcium carbonate filler formulated to cure in presence of atmospheric moisture with evolution of methanol. A piece (24) of a material suitable for attraction to the core (14) when activated is secured to the diaphragm (10). The piece is located in a position such that it may be drawn towards the core (14) when the coil is energised by passage of electric current through the coil. Thus, by actuation of the electromagnet the diaphragm (10) may be caused to vibrate. A wall of the housing has an opening (26) having a diameter of 5 mm. The opening contains the element (4) formed from a polysiloxane composition as hereinafter more fully described.

The element (4) comprises a cellular layer (28) having a skin (30) of a silicone composition disposed to be contacted by air outside the chamber and a surface (32), also provided by a skin of silicone composition, disposed in contact with air inside the chamber.

A tone disc (34) having a central opening (35) and extending generally parallel to the diaphragm (10) is secured at its periphery (36) to the periphery of the diaphragm by means of a bead (38) of the same sealant composition as is used to provide the bead (22).

The element (4) comprising the cellular layer (28) and the integral skins (30 and 32) was formed by casting into the opening (26) a room temperature vulcanising foam forming composition and allowing the composition to expand freely. The composition used comprised a polysiloxane composition formed by mixing 7 parts by weight stannous octoate with a composition comprising

| Material | Parts by Weight |
|---|---|
| $\alpha,\omega$, hydroxypolydimethylsiloxane, MW about 21,000 | 100 |
| $\alpha,\omega$, hydroxypolydimethylsiloxane, MW about 900 | 10 |
| Diphenylmethylsilanol | 10 |
| Trimethylsiloxy-endblocked methylhydrogenpolysiloxanes, viscosity $3 \times 10^{-5}$ $m^2/s$ (30 cSt) at 25° C. | 10 |
| Finely divided filler | 25 |
| n-propylorthosilicate | 4 |

The cellular layer (28) was a fine pored uniform foam comprising about 90% open cells and 10% closed cells and having a density of about 140 $kg/m^3$.

That which is claimed is:

1. An article having a chamber in which a quantity of air is enclosed which chamber is sealed against ingress of water in liquid form and is provided with an element through which air may permeate under the influence of differences between the pressures of air outside the chamber and air inside the chamber, the element being a plug of a foamed silicone comprising a cellular layer consisting of a fine pored foam of predominantly open cells having a skin disposed to be contacted by air outside the chamber and a second skin disposed in contact with air inside the chamber, and wherein the skins are of silicone composition.

2. An article according to claim 1 wherein the cellular layer has about 90% open cells and about 10% closed cells.

3. An article according to claim 1 wherein the element has been formed by a process involving moulding the silicone composition to desired shape under conditions in which the composition is free to expand.

4. An article according to claim 1 in the form of a vehicle horn in which the chamber is defined by a housing in which an electromagnet is mounted and a diaphragm secured to the housing and in that the element is located in a wall of the housing.

5. An article according to claim 1 characterised in the form of a vehicle headlamp in which the chamber is defined by a housing in which a reflector is located and a lens or glass secured to the housing and in that the element is located in a wall of the housing.

6. An article according to claim 1 wherein the element has a density of about 50 to about 250 kg/m$^3$.

7. An article according to claim 1 wherein the cellular layer comprises not less than about 60% open cells.

8. An element suitable for use in an article according to claim 1 comprising an annulus adapted to be secured in an opening in a wall of the chamber and which is filled with a foamed silicone rubber composition comprising a cellular layer having exposed outer skins of silicone composition.

9. A method of providing an element in an article having a chamber, in which a quantity of air is enclosed which chamber is sealed against ingress of water in liquid form through which element air may permeate under the influence of differences between the pressures of air outside the chamber and air inside the chamber, characterised in that the element is formed by moulding a foamable silicone composition to desired shape under conditions in which the composition is free to expand whereby to form a plug of a foamed silicone comprising a cellular layer consisting of a fine pored foam of predominantly open cells having a skin disposed to be contacted by air outside the chamber and a second skin disposed in contact with air inside the chamber, and wherein the skins are of silicone composition.

10. A method according to claim 9 wherein the element is moulded in situ.

11. A method according to claim 9 wherein the element is moulded in an annulus which is then secured in an opening in a wall of the chamber.

* * * * *